US007600464B2

(12) United States Patent
Cale et al.

(10) Patent No.: US 7,600,464 B2
(45) Date of Patent: Oct. 13, 2009

(54) MULTI-PIECE PISTON FOR A FREE PISTON MACHINE

(75) Inventors: E. Todd Cale, Coolville, OH (US); Aaron M. Courtney, Athens, OH (US); Jerry A Royse, Albany, OH (US)

(73) Assignee: Sunpower, Inc., Athens, OH (US)

( * ) Notice: Subject to any disclaimer, the term of this patent is extended or adjusted under 35 U.S.C. 154(b) by 299 days.

(21) Appl. No.: 11/734,377

(22) Filed: Apr. 12, 2007

(65) Prior Publication Data

US 2008/0250784 A1 Oct. 16, 2008

(51) Int. Cl.
*F01B 31/10* (2006.01)
*F02G 1/00* (2006.01)

(52) U.S. Cl. ..... 92/110; 92/153; 60/520

(58) Field of Classification Search ..... 92/110, 92/112, 153, 160; 60/520
See application file for complete search history.

(56) References Cited

U.S. PATENT DOCUMENTS 4,802,332 A * 2/1989 Beale ..... 92/153
5,502,968 A * 4/1996 Beale ..... 60/520
6,293,184 B1 9/2001 Unger
6,694,730 B2 * 2/2004 O'Baid et al. ..... 60/520
6,901,845 B2 * 6/2005 Kiikka ..... 92/153

* cited by examiner

*Primary Examiner*—Thomas E Lazo
(74) *Attorney, Agent, or Firm*—Frank H. Foster; Kremblas, Foster, Phillips & Pollick

(57) ABSTRACT

The concentricity and coaxiality of a central bore through a piston for a free piston Stirling machine is improved with a piston that has a sleeve with a core constructed from at least two, separate, axially-engaging core components sealed within the sleeve. During fabrication, a central bore is machined through each of the core components. The piston is assembled by heating the sleeve and cooling the core components, inserting the core components into the sleeve and then allowing the sleeve to cool and the core components to warm. This drives the core components into sealed engagement with each other and with the sleeve and aligns the central bore coaxially with the outer cylindrical surface of the sleeve.

11 Claims, 2 Drawing Sheets

Fig. 1
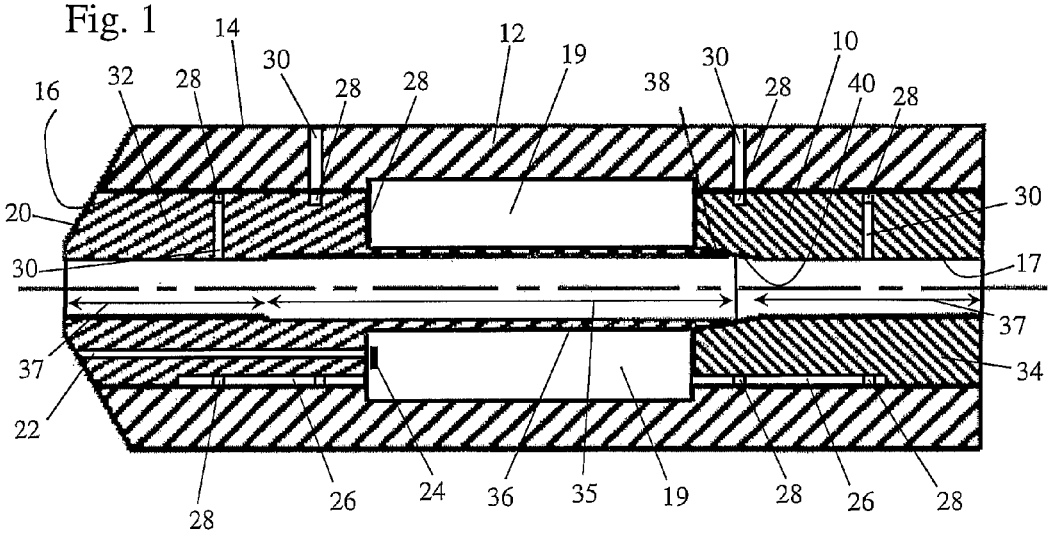
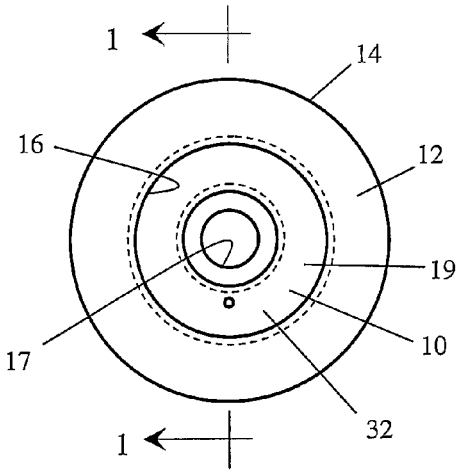
Fig. 2
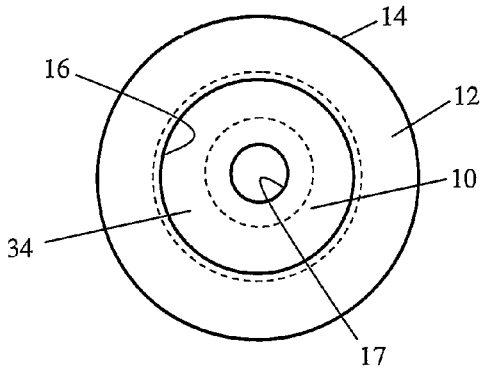
Fig. 3

MULTI-PIECE PISTON FOR A FREE PISTON MACHINE

BACKGROUND OF THE INVENTION

1. Field of the Invention

This invention relates generally to free piston machines, and more particularly to an improved piston for a free piston Stirling cycle machine wherein the improvement is the structure of the core for a multi-piece piston and a method for fabricating the improved piston.

2. Description of the Related Art

Free piston Stirling cycle machines have been used for many years in applications such as engines, coolers, and cryocoolers. In a Stirling machine, a working gas is confined in a work space comprised of an expansion space and a compression space. The working gas is alternately expanded and compressed by the reciprocation of a free piston or by variations in the working gas temperature. The working gas is shuttled between the compression space and the expansion space which are connected in fluid communication through a heat accepter, regenerator and heat rejecter. In a typical configuration, the shuttling is accomplished by a displacer connected to a displacer rod, the displacer being driven by variations in the working gas pressure.

Free piston Stirling cycle machines are designed to have relatively small gaps between the piston and the interfacing wall of the cylinder in which the piston reciprocates in order to minimize leakage between them. Additionally, some free piston Stirling machines have a reciprocating displacer rod that extends sealingly and slidably through a central bore in the piston into connection to a planar spring. The central bore and the displacer rod are also machined to have relatively small gaps for the same reason. To minimize wear of the interfacing, sliding surfaces around and within the piston, the gaps between the interfacing surfaces are continuously lubricated. The preferred method for achieving lubrication is through the use of gas bearings. A free piston machine employing a gas bearing lubrication system similar to the gas bearing system used with embodiments of the present invention is described in U.S. Pat. No. 6,293,184 to Unger, which is herein incorporated by reference. In these gas bearing lubrication systems, working gas is supplied from the work space through a check valve to a plenum that functions as a reservoir of pressurized working gas within the piston for use in the gas lubrication. The gas is distributed from the plenum through a network of annular, longitudinal and radial gas bearing passageways, including gas flow rate metering restrictions, to the piston surfaces that slide against other surfaces.

In order to facilitate forming the network of gas bearing passageways within the piston, the piston is typically fabricated as a two-piece body comprising a sleeve and a core. The core is coaxially within and sealed to the sleeve as shown and described in the above cited U.S. Pat. No. 6,293,184 to Unger. This multi-piece piston configuration is useful because it allows many of the gas bearing passageways and the plenum to be formed on the exterior surface of the core. That is advantageous because the exterior surface is more accessible and more easily machined through processes such as drilling, grinding, etching, and turning on a lathe before the pieces are assembled to form the piston. The core is then pushed into the sleeve, and the outer surface of the core is sealed to the inner surface of the sleeve by shrink-fitting or other sealing processes.

In Stirling machines having a displacer rod axially reciprocating through the piston, a central bore must be formed through the core of the piston to receive the displacer rod. This central bore should be coaxial with the cylinder wall in which the piston reciprocates, so that piston reciprocation and displacer reciprocation occur along parallel, coaxial paths. However, the core of a typical multi-piece piston is too long for the central bore to be accurately machined in a single boring operation from one end of the core and maintain a sufficient concentricity of the bore and the outside diameter of the core. The reason is that the axis of a bore becomes inaccurate after the length/diameter ratio of the bore exceeds 3 or 4 as a result of the long, overhung boring bar during the boring operation.

It is possible to machine two separate, shorter bores into the core, one from each end of the core, meeting at a point near the core's longitudinal center and creating a single, long bore extending along the entire length of the core. This can be done by clamping the workpiece in a chuck, turning the entire outside diameter and boring half way through the core. Then the core is removed from the chuck, turned around and its opposite end clamped in the chuck and then boring from the opposite end to meet the initial bore. However, coaxial alignment of two bores entering opposite ends of the core is very difficult to achieve because of alignment imperfections associated with each clamping of an outside diameter in a chuck. Consequently, by resorting to clamping the core twice, once at each end, the alignment variations between the two result in variations in the alignment of the two bores each one formed when a different end was clamped. Misalignment of the axes of the two bores results in one or more intervals along the length of the piston in which the cylindrical outer wall of the piston and the cylindrical interior wall of the central bore are not concentric. Such compromises of the coaxiality and the concentricity of the central bore relative to the peripheral cylindrical outer surface of the outer sleeve degrade the performance of the piston and the displacer and impose a lower limit on the permissible size of the gap between the relatively sliding surfaces.

It is therefore an object and feature of the invention to provide a multi-piece piston having improved coaxiality and concentricity of the central bore and the outer cylindrical surface of the outer sleeve along the entire length of the piston, and to provide a method for making the same, for a free piston machine.

BRIEF SUMMARY OF THE INVENTION

The invention is an improved multi-piece piston for a free piston machine. The piston is the prior art type having an inner core axially fixed within and sealingly engaging an outer sleeve. The core has a cavity formed on its exterior surface for providing a gas bearing plenum. The piston has a network of gas bearing passages in fluid communication with the plenum and extending through the piston to form a gas bearing lubrication system. The improvement of the invention comprises a core having a first core component and a second core component that axially engage each other at interfacing ends, each core component having a coaxial, central bore extending along its entire length. Preferably, the first core component is sealingly engaged to the second core component. This construction of the core of the piston with multiple core components allows the machining of the central bore for each core component to be more nearly concentric and coaxial with the outer cylindrical surface of the piston and therefore the composite central bore of the piston has improved concentricity and coaxiality along its entire length. In order to assemble the core components into the sleeve, the sleeve is first heated to increase its length and diameter and the core components are cooled to decrease their length and diameter. Then both core components are slid axially into the sleeve with a neck that protrudes axially from the first core component engaging a mating shoulder of the second core component. The sleeve is then allowed to cool and the core components to warm thereby forcing the core components axially and radially together and sealing the neck to the shoulder, axially aligning the core components within the sleeve and sealing and fixing the sleeve to the core components.

BRIEF DESCRIPTION OF THE SEVERAL VIEWS OF THE DRAWINGS

FIG. 1 is a view in longitudinal, axial section of the preferred embodiment of the invention taken substantially along the line 1-1 of FIG. 2.

FIG. 2 is a view in left end elevation of the embodiment of FIG. 1.

FIG. 3 is a view in right end elevation of the embodiment of FIG. 1.

Figure 4:
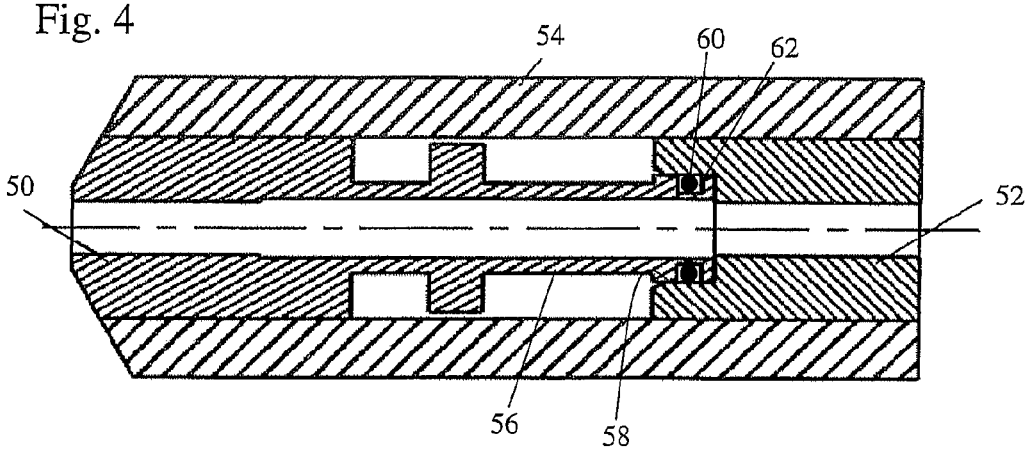
FIG. 4 is a view in longitudinal, axial section of an alternative embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

FIGS. 1-3 illustrate the preferred multi-piece piston embodying the invention. The piston has an inner core 10 axially within and sealingly engaging an outer sleeve 12. The sleeve is machined to have a cylindrical exterior surface 14 and a coaxial, inner cylindrical surface 16. The core 10 has an axial, cylindrical, central bore 17 for sliding receipt of a displacer rod. The core 10 also has an annular cavity formed machined into its exterior surface to provide a gas bearing plenum 19 bounded on its outer periphery by the interior surface 16 of the sleeve 12. The piston also has a network of gas bearing passages in fluid communication with the plenum 19 and extending through the piston to form a gas bearing lubrication system similar to the gas bearing lubrication system with its network of gas passages illustrated in the above cited Unger patent.

Figure 5:
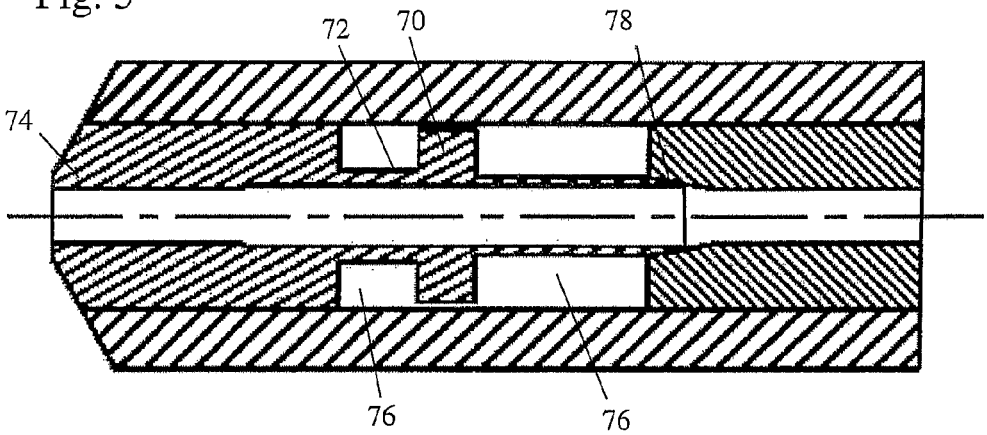
FIG. 5 is a view in longitudinal, axial section of another alternative embodiment of the invention.
Figure 6:
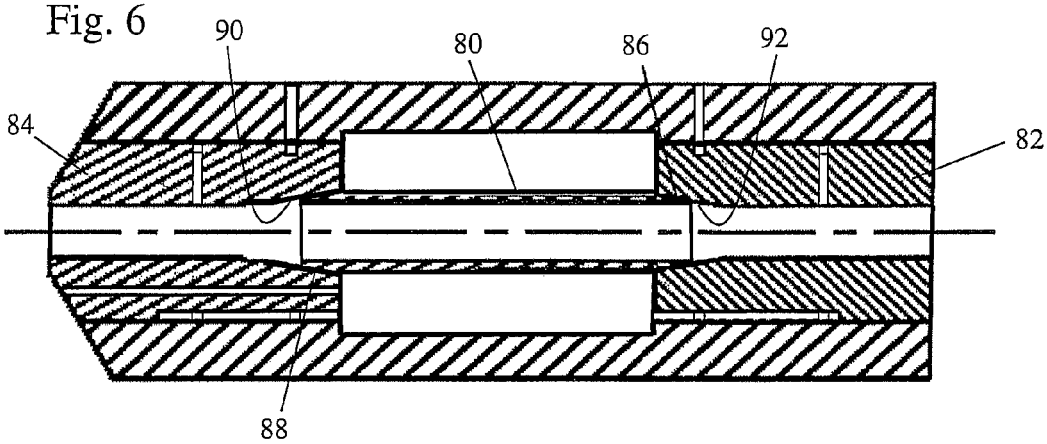
FIG. 6 is a view in longitudinal, axial section of yet another alternative embodiment of the invention.

Although the gas bearing system is not a part of, or unique to, the invention, a representative example of a gas bearing system is illustrated in FIG. 1, although the gas bearing system is omitted from the embodiments of FIGS. 4-6. Referring to FIG. 1, working gas enters the lubrication system from the working space end 20 of the piston by flowing through a passage 22 and past a check valve 24 whenever the cyclically varying gas pressure in the working space exceeds the gas pressure in the plenum 19. Gas passes from the plenum 19 through a series of distribution slots 26 that are machined into the outer cylindrical surface of the core 10 parallel to the central axis of the core 10 at spaced angular intervals around the periphery of the core 10. The distribution slots 26 intersect annular grooves 28 that direct the gas to several radial, gas bearing cavities 30 that are also formed at spaced angular intervals around the axis of the piston. The annular grooves are typically relatively small restricted passages for metering the gas flow rate from the plenum 19 to the bearing cavities 30. Some of the bearing cavities open through the outer peripheral surface 14 of the piston while others open through the interior surface of the central bore 17.

Critically important to the invention, the core is comprised of multiple core components, each of which can have its central bore separately and more accurately machined through it than is possible with a single core extending the entire length of the piston. In the embodiment of FIG. 1, a first core component 32 and a second core component 34 axially engage each other at their interfacing ends. Each core component has a coaxial, central bore extending along its length. Preferably, the first core component 32 has a neck 36 that extends into sealing engagement with the second core component 34 at a joint formed at their engaging ends. The interior of the neck 36 is counter-bored along a length or longitudinal segment 35 to a larger inside diameter that is greater than the diameter of the remaining bores in each of the core components so the coaxiality along the counter-bore is not critical. Preferably, the ratio of the bore length of the remaining smaller diameter bore in each core component, which is along the longitudinal segments 37, to the diameter of the smaller diameter bore does not exceed 5 in either core component. Most preferably, that ratio is in the range of 3 to 4.

FIG. 1 illustrates the preferred configurations of the interfacing ends that form a joint that seals the core components 32 and 34 together upon assembly of the piston. The first core component 32 has a cylindrical, coaxially-protruding neck 36 with a conical exterior end surface 38 that is matingly received in and engages the surface of a conical, coaxial shoulder 40 formed in the second core component 34 for creating the sealing engagement between the core components. Although the core components 32 and 34 can be joined together at this conical joint by applying oppositely directed forces at the opposite ends of the core components, they are preferably joined by the method of the invention which is described below. Although a conical taper is preferred, other taper configurations may be used. For example, one or both of the joining surfaces can be curved, such as with a parabolic curve to form a paraboloidal surface. As a further alternative, the end of the neck 36 can have a flared, bell mouth end that seats against the proximal end surface of the core component 34 and is forced into sealing engagement with the end surface when the two core components are forced together as described below.

FIG. 4 illustrates a first alternative embodiment that also has a first core component 50, a second core component 52 and an outer sleeve 54. The first core component 50 has a coaxially-protruding neck 56 that matingly engages a coaxial shoulder 58 formed by a counter-bore in the second core component 52. The neck 56 has an annular groove 60 in which an O-ring 62 is seated for creating a seal between the neck 56 and the shoulder 58. In this way, the FIG. 4 embodiment of the invention uses an O-ring at the juncture where the core components axially engage each other for creating the sealing engagement between the core components.

FIG. 5 illustrates a second alternative embodiment of the invention which is like the embodiment illustrated in FIGS. 1-3, including its tapered joint 78, except that it has a peripheral flange 70 extending outwardly from the neck 72 of a first core component 74 and interposed in a plenum 76. The flange 70 is optional, not a part of the invention and resists and reduces the "hour glass" diametrical expansion of the neck 72 when the core components are forced against each other in the manner described below. The flange can also be milled flat sides along a plane that is parallel to and radially spaced out from the central axis and the flat surface used for mounting the check valve but this is not a part of and does not have an effect upon the invention. Preferably, the flange is milled on diametrically opposite sides along parallel planes for symmetry and mass reduction.

FIG. 6 illustrates a third alternative embodiment of the invention. This embodiment is like the embodiment of FIGS. 1-3 except that the neck 80 is first core component formed separately from a second core component 82 and a third core component 84. The opposite ends 86 and 88 of the separate neck core component 80 are both formed with a conical exterior end surface like the conical end surfaces on the end of the neck 36 illustrated and described in association with FIGS. 1-3. Similarly, the centrally facing ends of the second core component 82 and the third core component 84 are formed with conical, coaxial shoulders 90 and 92. This allows the conical ends of the neck core component 80 to be forced into the conical, coaxial shoulders 90 and 92 to seal the three core components together. Consequently, this third alternative embodiment provides a third core component having the core components arranged end to end and axially engaging each other at interfacing ends within the sleeve. Each of the three core components has a separately machined, coaxial, central bore extending along its entire length with the intermediate core component having opposite ends with conical exterior surfaces that matingly engage a conical, coaxial shoulder in each of the other core components for creating the sealing engagement between the core components and aligning the central bores. Alternatively, other types of sealing ends may be used to form sealed joints including O-ring joints as illustrated in FIG. 4 or other tapered surfaces.

The present invention solves the problem of the impracticality of drilling or otherwise machining the central passage through a piston with sufficient accuracy that the central passage and the exterior cylindrical surface of the piston are optimally concentric and coaxial. The invention divides the core of a two piece piston into multiple core components that are distributed along the piston axis and are sealed together.

However, the benefits of this solution diminish both as the length of a core component increases and as the number of core components increases. Although the invention may be practiced and some advantage gained with any number of core components, we believe that, preferably, the coaxially protruding neck is counter-bored to have an inside diameter that is greater than the diameter of the remaining bores in each of the core components and the ratio of the bore length of the smaller diameter bore to the diameter of the smaller diameter bore of each core component should not exceed 5. Most preferably, the ratio of the bore length of the smaller diameter bore to the diameter of the smaller diameter bore within each core component is within the range of 3 to 4. In the embodiment of FIG. 6, the entire third core component 80 is formed with a larger diameter bore and the same ratios of bore length to bore diameter for the core components 82 and 84 are preferred.

With the invention, each core component is separately machined but can be machined in one set up. Both the outside diameter and the inside diameter (the bore) of each core component are machined during that one set up of a lathe. The workpiece is clamped in the chuck and both the outside diameter and the inside diameter are machined without removing the workpiece until both are completed. By using multiple core components, the length of each bore can be within the preferred limits of a bore length to bore diameter ratio in the range of 3 to 4. This allows each component to have maximum concentricity so that, when the core components are inserted into the outer sleeve, the outer sleeve aligns the core components and the composite bore for the piston has maximum concentricity along its entire length.

The sleeve and the core components are preferably assembled using a heat shrinking method to assemble, press together, sealingly engage and mechanically fix the sleeve and the core components together. The outer sleeve is fabricated with an outer cylindrical surface appropriate for the diameter of the cylinder in which the piston reciprocates and an inner diameter D. The first core component is fabricated with a cylindrical outer surface having a diameter at least equal to D, a coaxial, central bore having a diameter appropriate for the displacer rod and a coaxially-protruding neck. The second core component is fabricated with a cylindrical outer surface having a diameter at least equal to D, a coaxial, central bore identical to the central bore of the first core component and a coaxial shoulder for matingly receiving the neck.

To assemble the components into a piston, the sleeve is heated to increase its length and diameter and the core components are cooled to decrease their length and diameter. For example, if the sleeve and the core components are constructed of aluminum, the sleeve may be heated to 245° C., and the core components cooled to 0° C.

Both core components are then axially slid or forced into the sleeve with the tapered end of the neck of the first core component engaging the tapered shoulder of the second core component. The sleeve is then allowed to cool and the core components are allowed to warm thereby forcing the core components axially together and sealing the neck to the shoulder until the temperature of the sleeve and the core components normalizes at room temperature. The longitudinal compression or shrinkage of the sleeve, resulting from its cooling, and the longitudinal expansion of the core components resulting from their warming, forces the core components longitudinally toward each other to force the joint at their intersection together and seal it. This is particularly effective to force the exterior conical surface at the end of the neck into the mating conical shoulder and seal them together. Simultaneously, the radial compression of the sleeve about the core components seals the interface between the core components and the sleeve. This also axially aligns the core components within the sleeve so that the central bore is optimally concentric and coaxial along its entire length with both the inner cylindrical surface and the outer, peripheral surface of the sleeve.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved multi-piece piston for a free piston machine, the piston having an inner core axially within and sealingly engaging an outer sleeve, the core having a cavity formed on its exterior surface forming a gas bearing plenum, the piston having a network of gas bearing passages in fluid communication with the plenum and extending through the piston to form a gas bearing lubrication system, wherein the improvement comprises the core having:

a first core component and a second core component that axially engage each other at interfacing ends, each core component having a coaxial, central bore extending along its entire length, the first core component being sealingly engaged to the second core component and having a coaxially-protruding neck that has an end that sealingly engages the second core component, the neck having a tapered exterior surface that matingly engages a tapered, coaxial shoulder in the second core component for creating the sealing engagement between the core components.

2. The improved multi-piece piston of claim 1, wherein the tapered exterior surface and the tapered, coaxial shoulder are tapered with conical surfaces.

3. The improved multi-piece piston of claim 1, wherein an O-ring is positioned at a joint where the core components axially engage each other for creating the sealing engagement between the core components.

4. The improved multi-piece piston of claim 3, wherein the neck matingly engages a coaxial shoulder in the second core component, the neck having an annular groove in which the O-ring is seated for creating a seal between the neck and the shoulder.

5. The improved multi-piece piston of claim 1, wherein the coaxially protruding neck is counter-bored to have an inside diameter that is greater than the diameter of the remaining bores in each of the core components.

6. The improved multi-piece piston of claim 5, wherein the ratio of the bore length of the smaller diameter bore to the diameter of the smaller diameter bore of each core component does not exceed 5.

7. The improved multi-piece piston of claim 6, wherein the ratio of the bore length of the smaller diameter bore to the diameter of the smaller diameter bore of each core component is within the range of 3 to 4.

8. The improved multi-piece piston of claim 1 and further comprising a third core component, the core components arranged end to end and axially engaging each other at interfacing ends within the sleeve, each core component having a coaxial, central bore extending along its entire length, the third core component being an intermediate core component having opposite ends with conical exterior surfaces that matingly engage a conical, coaxial shoulder in each of the other core components for creating the sealing engagement between the core components.

9. The improved multi-piece piston of claim 8, wherein the intermediate core component has an inside diameter that is greater than the diameter of the bores in each of the other core components.

10. The improved multi-piece piston of claim 9, wherein the ratio of the bore length of the smaller diameter bore in the first and second core components to the diameter of the smaller diameter bore in the first and second core components does not exceed 5.

11. The improved multi-piece piston of claim 10, wherein the ratio of the bore length of the smaller diameter bore in the first and second core components to the diameter of the smaller diameter bore in the first and second core components is within the range of 3 to 4.

* * * * *

UNITED STATES PATENT AND TRADEMARK OFFICE

CERTIFICATE OF CORRECTION

PATENT NO. : 7,600,464 B2
APPLICATION NO. : 11/734377
DATED : October 13, 2009
INVENTOR(S) : E. Todd Cale et al.

It is certified that error appears in the above-identified patent and that said Letters Patent is hereby corrected as shown below:

IN THE SPECIFICATION

Insert at Column 1, Line 5

--This invention was made with Government support under contract NAS3 03128 awarded by NASA. The Government has certain rights in the invention.--

Signed and Sealed this
Fifteenth Day of March, 2016

Michelle K. Lee

Michelle K. Lee
*Director of the United States Patent and Trademark Office*